US011198592B2

(12) United States Patent
van Eijgen

(10) Patent No.: US 11,198,592 B2
(45) Date of Patent: Dec. 14, 2021

(54) STAIRLIFT

(71) Applicant: THYSSENKRUPP STAIRLIFTS B.V., Krimpen aan den Ijssel (NL)

(72) Inventor: Wilco van Eijgen, Rijnsburg (NL)

(73) Assignee: TK Home Solutions B.V., Krimpen aan den Ijssel (NL)

( * ) Notice: Subject to any disclaimer, the term of this patent is extended or adjusted under 35 U.S.C. 154(b) by 348 days.

(21) Appl. No.: 16/483,783

(22) PCT Filed: Jan. 16, 2018

(86) PCT No.: PCT/EP2018/050988
§ 371 (c)(1),
(2) Date: Aug. 6, 2019

(87) PCT Pub. No.: WO2018/145862
PCT Pub. Date: Aug. 16, 2018

(65) Prior Publication Data

US 2019/0382243 A1 Dec. 19, 2019

(30) Foreign Application Priority Data

Feb. 8, 2017 (DE) ..... 10 2017 202 010.5

(51) Int. Cl.
*B66B 9/08* (2006.01)
*B66B 5/02* (2006.01)

(52) U.S. Cl.
CPC . *B66B 9/08* (2013.01); *B66B 5/02* (2013.01)

(58) Field of Classification Search
CPC ..... B66B 9/08; B66B 5/02; A61G 2203/12
See application file for complete search history.

(56) References Cited

U.S. PATENT DOCUMENTS 4,043,427 A * 8/1977 Ackerman ..... B66B 9/083 187/201
5,137,102 A * 8/1992 Houston, Sr. ..... A61G 5/042 180/65.51

(Continued)

FOREIGN PATENT DOCUMENTS

CN 1302762 A 7/2001
CN 102259780 A 11/2011

(Continued)

OTHER PUBLICATIONS

Office Action in Chinese counterpart application No. 201880010411.5, dated Jun. 28, 2020, which cites prior art references listed above.

(Continued)

*Primary Examiner* — Michael A Riegelman
(74) *Attorney, Agent, or Firm* — William J. Cassin

(57) ABSTRACT

A stairlift may include a rail, a chair with an armrest, a carrier that has a drive motor and is drivable along the rail, a control unit, and a first input device located at the at least one armrest and configured to provide a signal to the control unit to transport a user in a first driving direction. The control unit may start or stop a movement of the carrier in the first direction based at least on the signal of the first input device. The stairlift may also include a second input device that is separate from the first input device, and configured to provide a signal to the control unit to transport the user in the first driving direction. Further, the control unit may be adapted to start or stop the movement of the carrier based on the signal of the second input device.

12 Claims, 2 Drawing Sheets

(56) References Cited

U.S. PATENT DOCUMENTS

| | | | | |
|---|---|---|---|---|
| 5,228,538 | A * | 7/1993 | Tremblay | B66B 9/00 180/270 |
| 7,537,069 | B2 * | 5/2009 | Kramer | A47C 7/62 180/21 |
| 2006/0260876 | A1 * | 11/2006 | Woodhams | B66B 9/08 187/201 |
| 2008/0271953 | A1 * | 11/2008 | Vroegindeweij | B66B 9/0838 187/245 |
| 2010/0117585 | A1 * | 5/2010 | Fitch | B25J 19/06 318/568.12 |
| 2011/0278096 | A1 * | 11/2011 | Kentenich | B66B 1/3461 187/201 |
| 2017/0158464 | A1 * | 6/2017 | De Kroon | B66B 9/0838 |
| 2017/0267508 | A1 * | 9/2017 | Huber | B66F 11/044 |
| 2018/0072537 | A1 * | 3/2018 | Pugh | B66B 9/0807 |
| 2019/0382243 | A1 * | 12/2019 | van Eijgen | B66B 5/02 |
| 2020/0017332 | A1 * | 1/2020 | Boxum | B66B 1/30 |
| 2020/0283262 | A1 * | 9/2020 | Piper | B66B 1/3407 |
| 2021/0163263 | A1 * | 6/2021 | Boxum | B66B 9/08 |

FOREIGN PATENT DOCUMENTS

| | | | |
|---|---|---|---|
| CN | 102556778 | A | 7/2012 |
| CN | 103010867 | A | 4/2013 |
| CN | 105236242 | A | 1/2016 |
| CN | 105293221 | A | 2/2016 |
| CN | 105692397 | A | 6/2016 |
| EP | 2377795 | A | 10/2011 |
| EP | 2377795 | A1 | 10/2011 |
| GB | 2137589 | A | 10/1984 |
| GB | 2269252 | A | 2/1994 |
| JP | H10 139315 | A | 5/1998 |
| JP | 2004-142929 | A | 5/2004 |
| WO | 9008669 | A | 8/1990 |
| WO | 2008/074967 | A2 | 6/2008 |
| WO | 2008074967 | A | 6/2008 |
| WO | 2013129923 | A | 9/2013 |
| WO | 2016/087282 | A1 | 6/2016 |

OTHER PUBLICATIONS

English Translation of International Search Report issued in PCT/EP2018/050988, dated May 23, 2018.

Office Action dated Sep. 18, 2020 in Canadian counterpart application No. CA 3,051,630, citing the references listed herein, that have not yet been listed in any IDS filed in the present US application.

Stannah Stairlifts Brochure entitled "Looking After Your Stairlift; Model: 600 Siena"; Issue 3, Jan. 2013.

* cited by examiner

STAIRLIFT

CROSS REFERENCE TO RELATED APPLICATIONS

This application is a U.S. National Stage Entry of International Patent Application Serial Number PCT/EP2018/050988, filed Jan. 16, 2018 which claims priority to German Patent Application No. DE 10 2017 202 010.5, filed Feb. 8, 2017, the entire contents of both of which are incorporated herein by reference.

FIELD

The present disclosure generally relates to stairlifts, including stairlifts for transporting people between floors.

BACKGROUND

WO 2013/129923 A1 discloses a stairlift. The stairlift comprises a chair mounted on a carrier. The carrier travels along at least one guide rail. A leveling mechanism is provided to hold the chair always in a horizontal orientation, even if the inclination angle of the guide rail is changing.

Conventional stair lifts are equipped with an emergency lowering device. Should a fault occur while the carrier is travelling, the stairlift can be lowered downwards manually. Therefore a lever is installed within "easy reaching distance"; when activated, the lift will slowly be lowered. The user does not have to get off the lift halfway up the stairs and can wait for the safe stopping point.

The lever has a priority higher than the priority of an emergency stop button. So if the emergency stop button is pressed, the user can still activate the downward movement of the carrier by activating the lever. Due to safety reasons, in particular to prevent misuse of the lowering function, the lever is located merely "within easy reaching distance", for example as a bowden cable located at the carrier, but not very ergonomically. For some handicapped people, the lever is actually not reachable at all.

Thus a need exists to improve the ergonomics of the stair lift with respect to the emergency lowering function, while maintaining a high safety standard.

DETAILED DESCRIPTION

Figure 1:
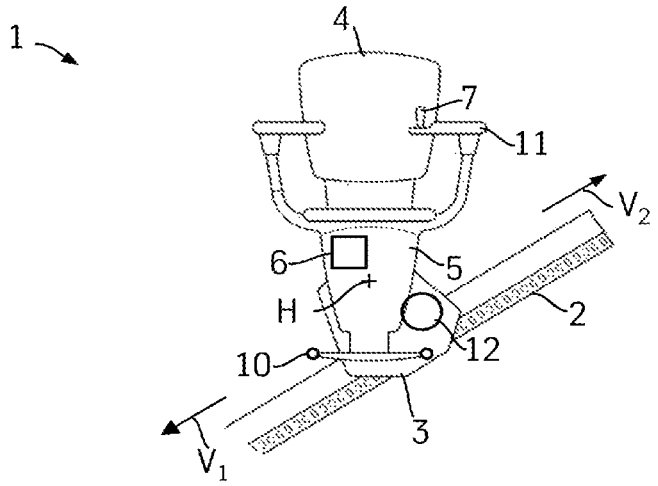
FIG. 1 is a front view of a conventional stairlift.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The inventive stairlift comprises a rail, a chair having at least one armrest, a carrier having a drive motor, the carrier is adapted to drive along the rail, a first input device located at one of the armrests, the first input device is adapted to provide a signal to the control unit, that the user wants to travel in a first driving direction, in particular upwards or downwards, a control unit adapted to start or to stop a movement of the carrier in the first direction at least based on the signal of the first input device, According to the invention a second input device, separate to the first input device, is located at one of the armrests, the second input device is also adapted to provide a signal to the control unit, that the user wants to travel in the first driving direction and the control unit is adapted to start or to stop a movement of the carrier in the first direction based on the signal of the second input device.

The invention proposes to arrange a user input device for activating the emergency lowering device at the armrest. Here the button is reachable for nearly every person without luxation.

In an embodiment a safety sensor is mounted at the stair lift, in particular a collision sensor, adapted to provide a safety sensor signal; the control unit is adapted to stop the movement of the carrier, in particular movement in the first driving direction, as a response to the safety sensor signal. A safety sensor may any sensor or electronic equipment, which can detect situations in the area of the stair lift. Also a radar observation arrangement including complex analyzing software is considered as a safety sensor.

In a preferred embodiment the control unit is adapted to overrule the signal of the safety sensor by the signal of the second input device. So in case the carrier is trapped due to a collision sensor signal the user has the ability to force the carrier to move on.

In an embodiment and to improve safety the control unit is adapted to start the operation of the stairlift in response to the signal of the second input device only if a movement operation of the carrier in the first direction is not possible as a response to the signal off the first input device. So only if the first input device "does not work", the user is able to force the carrier movement with the help of the second input device.

In an embodiment the stairlift comprises an emergency stop input device, wherein the control unit is adapted to overrule the signal of the second input devices by the signal of the emergency stop input device. In contrast to the prior art the emergency stop input device has the highest priority and can overrule in particular all other input devices and sensors.

A signal may be an analog or digital signal; also a "power-off" signal, usually used in connection with an emergency stop switch, can be considered as a signal.

An input device is intended to receive a user command. A safety sensor is not considered to be an input device.

Figure 2:
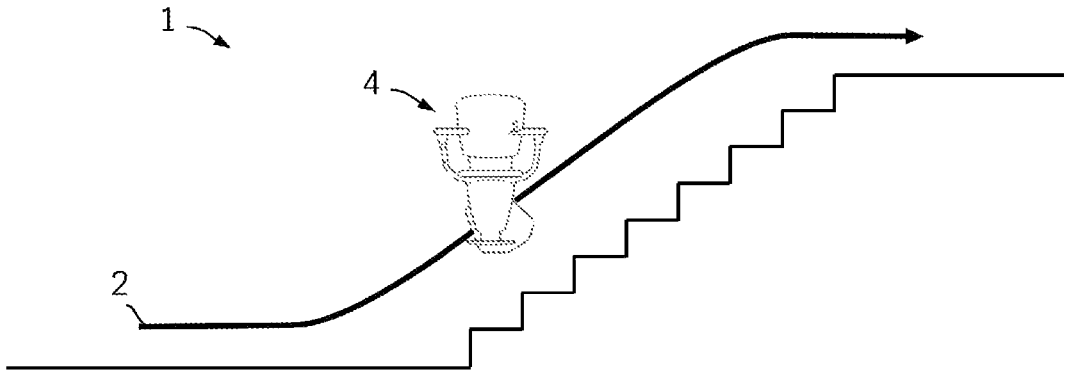
FIG. 2 is a view of the stairlift of FIG. 1 with a carrier traveling along the rail.

FIGS. 1 and 2 show an inventive stairlift 1. The stairlift 1 comprises a rail 2 and a carrier 3, which travels along the rail 2 in an upwards direction $V_2$ or in a downwards direction $V_1$. The chair 4, having a seating, a backrest, footrest and an armrest 11, is mounted on a leveling platform 5. The leveling platform 5 is mounted on the carrier 3. To keep the leveling platform 5 always in a constant orientation, a leveling mechanism (not shown) is provided between the carrier and the leveling platform 5, which supports the leveling platform 5 rotatably against the carrier 3 along a horizontal axis H. So when the orientation of the carrier 3 changes during the ride along the rail 2, the leveling mechanism is adapted to keep the leveling platform 5 always in a constant orientation.

Figure 3:
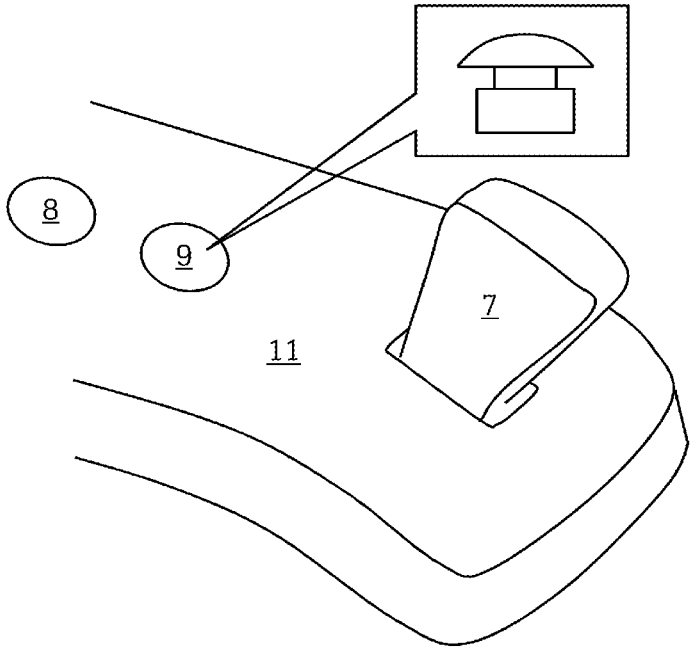
FIG. 3 is a schematic perspective view of an armrest of the chairlift stair of FIG. 1.

The function of the stairlift 1 is controlled by a control unit 6. FIG. 3 shows the armrest 11 having a first input device 7, here a bidirectional joystick 7. By moving the joystick 7 the user can trigger a signal to the control unit 6, that the user wants to travel e.g. downwards (first driving direction). A collision sensor is 10 provided, e.g. at the footrest (other locations may possible as well). When during downward movement the collision sensor 10 detects a collision with any obstacle, the control unit 6 stops the movement of the carrier 3. For handicapped people this may become a very unfavorable situation. Now further operation, in particular downward movement of the carrier, is prevented by the control unit due to safety reasons. In a worst case scenario the carrier may get trapped in the middle of a stairway, in particular if an additional obstacle appears on the stairlift preventing also an upward movement the (e.g. a bag or a piece of clothing drops form the chair on the stairs). Handicapped people are not able to exit the chair without an enormous risk of injuries. Alternatively the carrier may get trapped in the middle of the stairway due to a sensor failure.

Independent from the exact reason and according to the invention the user has the opportunity to give an additional command to the control unit 6, that the user wants to travel downwards at a location, where the user can safely exit the chair. Therefore the user can activate a second input device 8, here a press button, which outputs a further signal to the control unit 6 that the user wants to travel downwards. Even if the collision sensor outputs a stop-signal to the control unit, the control unit 6 activates the drive motor 12 to perform a downward movement. Here the user can decide that in contrary to the collision sensor signal the carrier should proceed with movement. An obstacle then may be shifted away by the stair lift.

In this situation the collision sensor is out of order. When an obstacle is detected by the collision sensor, the drive motor 12 will continue to drive the carrier. An available possibility to stop the drive motor 12 is to press an emergency stop button 9, which here is also attached to the armrest 11.

Figure 4:
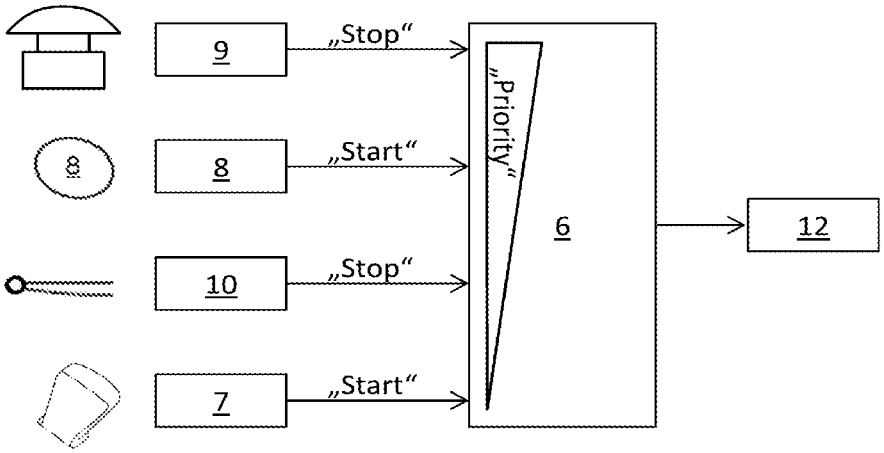
FIG. 4 is a block diagram of example electric components of the stairlift of FIG. 1.

The second input 8 device thus provides a possibility to activate the drive motor 12 even if the collision sensor 10 "wants" to prevent a further movement of the carrier 3, in particular in a safety mode. In a safety mode the carrier speed may be reduced, to reduce the risk of injuries. However safety is reduced during this operation, since the collision sensor is overruled by the second input device. The ranking of priority of the input and sensing devices 7-10 is shown in the block diagram of FIG. 4.

For preventing misuse of the second input device 8 the control unit 6 may be adapted to activate the operation of the carrier 3 as a response of the signal form the second input device 8 only in a situation, in which an activation of the drive motor 12 by the first input device 7 is not possible, in particular a safety sensor 10 prevents the further movement. So if the user initially wants to start movement by activating the second input device 8, the drive motor 12 will not start operation. So the user is forced to use the normal operation mode first by using the first input device 7, otherwise the stair lift will not operate. Only if the normal operation is prevented, in particular due to a sensor failure, it is allowed to activate the drive motor 12 by means of the second input device 8.

LIST OR REFERENCE SIGNS

1 stairlift
2 rail
3 carrier
4 chair
5 leveling platform
6 control unit
7 first input device/control stick
8 second input device/emergency lowering button
9 emergency stop input device
10 collision sensor
11 armrest
12 drive motor
$V_1$, $V_2$ direction of travel
H horizontal leveling axis

What is claimed is:

1. A stairlift comprising:
a rail;
a chair having at least one armrest;
a carrier having a drive motor, wherein the carrier is drivable along the rail;
a control unit;
a first input device disposed at the at least one armrest, the first input device being configured to provide a signal to the control unit to transport a user in a first driving direction, wherein the control unit is configured to start or stop a movement of the carrier in the first driving direction based at least on the signal of the first input device; and
a second input device separate from the first input device and disposed at the at least one armrest, wherein the second input device is configured to provide a signal to the control unit to transport the user in the first driving direction, wherein the control unit is configured to start or stop the movement of the carrier in the first driving direction based on the signal of the second input device.

2. The stairlift of claim 1 comprising a safety sensor configured to provide a safety sensor signal, wherein the control unit is configured to stop the movement of the carrier in the first driving direction in response to the safety sensor signal.

3. The stairlift of claim 2 wherein the control unit is configured to overrule the safety sensor signal by the signal of the second input device.

4. The stairlift of claim 1 wherein the control unit is configured to start operation of the stairlift in response to the signal of the second input device only if a movement operation of the carrier in the first driving direction is not possible as a response to the signal of the first input device.

5. The stairlift of claim 1 comprising an emergency stop input device, wherein the control unit is configured to overrule the signal of the second input device by a signal of the emergency stop input device.

6. The stairlift of claim 1 comprising a collision sensor configured to provide a safety signal, wherein the control unit is configured to stop the movement of the carrier in the first driving direction in response to the safety signal.

7. A stairlift comprising:
a rail;
a chair;

a carrier having a drive motor, wherein the carrier is drivable along the rail;

a control unit;

a first input device disposed at the chair, the first input device being configured to provide a signal to the control unit to transport a user, wherein the control unit is configured to start or stop a movement of the carrier based at least on the signal of the first input device; and a second input device separate from the first input device and disposed at the chair, wherein the second input device is configured to provide a signal to the control unit to transport the user, wherein the control unit is configured to start or stop the movement of the carrier based on the signal of the second input device.

8. The stairlift of claim 7 comprising a safety sensor configured to provide a safety sensor signal, wherein the control unit is configured to prevent or stop the movement of the carrier in response to the safety sensor signal.

9. The stairlift of claim 8 wherein the control unit is configured to overrule the safety sensor signal by the signal of the second input device.

10. The stairlift of claim 7 wherein the control unit is configured to start operation of the stairlift in response to the signal of the second input device only if movement of the carrier is not possible as a response to the signal of the first input device.

11. The stairlift of claim 7 comprising an emergency stop input device, wherein the control unit is configured to overrule the signal of the second input device by a signal of the emergency stop input device.

12. The stairlift of claim 7 comprising a collision sensor configured to provide a safety signal, wherein the control unit is configured to stop the movement of the carrier in response to the safety signal.

* * * * *